United States Patent [19]

Ridgway

[11] 4,091,997

[45] May 30, 1978

[54] ROTARY SPRINKLER ARC ADJUSTMENT

[75] Inventor: H. Curtis Ridgway, Dallas, Tex.

[73] Assignee: Telsco Industries, Inc., Dallas, Tex.

[21] Appl. No.: 759,728

[22] Filed: Jan. 17, 1977

[51] Int. Cl.[2] ..... B05B 3/08

[52] U.S. Cl. ..... 239/206; 239/230

[58] Field of Search ..... 239/206, 230, DIG. 1

[56] References Cited

U.S. PATENT DOCUMENTS

| | | | |
|---|---|---|---|
| 2,928,608 | 3/1960 | Royer | 239/230 |
| 3,033,469 | 5/1962 | Green | 239/230 |
| 3,051,396 | 8/1962 | McElhenie | 239/230 |
| 3,070,314 | 12/1962 | Warren | 239/230 |
| 3,625,429 | 12/1971 | Turrell | 239/230 |

*Primary Examiner*—Robert W. Saifer

*Attorney, Agent, or Firm*—Richards, Harris & Medlock

[57] ABSTRACT

Arc adjustment structure is provided for a rotary sprinkler having a rotatable nozzle supported from a shaft with the reversing mechanism attached to the nozzle and extending from the nozzle in the direction of the shaft. A notched ring is fixedly attached to the shaft below the nozzle. A first wire locking collar has one end compressively encircling the shaft above the annular gear and the opposite end formed in a loop extending radially from the shaft and terminating in a lateral end section for engagement with the teeth of the gear. A second wire locking collar has one end compressively encircling the shaft below the annular gear with the opposite end formed in a loop extending radially from the shaft and terminating in a lateral end section for engagement with the teeth of the gear. The locking collars are positioned such that the loops intercept the actuating arm of the reversing mechanism as the nozzle of the rotary sprinkler rotates on the shaft. The locking collars are positioned to any selected position about the circumference of the annular gear to control the arc through which the sprinkler operates.

14 Claims, 4 Drawing Figures

ROTARY SPRINKLER ARC ADJUSTMENT

BACKGROUND OF THE INVENTION

1. Field of the Invention

The present invention relates to a rotary pulsating sprinkler and more particularly to a system for accurately controlling the arc through which the sprinkler operates.

2. Prior Art

Rotary sprinklers in common use today incorporate a rotatable body carrying a laterally directed nozzle for distributing water or other fluids to a desired area. The main body and nozzle are rotated by an impact arm also rotatable with the body which is actuated by the reaction of a stream of water upon the arm. The arm is deflected against a spring which returns the arm for rotational impact with the body. A reversing mechanism is attached to the body. As the reversing mechanism rotates with the body it engages adjustable stops fixed to the shaft on which the body and nozzle rotate and control the arc through which the sprinkler operates. In the operation of the rotary sprinkler, the nozzle will continue to rotate in one direction until the reversing mechanism engages a first stop causing the reversing mechanism to reverse the direction of rotation of the sprinkler. The sprinkler then rotates in the opposite direction until the reversing mechanism engages a second stop whereby the sprinkler is again reversed in its direction of rotation. Thus, by moving the first and second stops around the circumference of the shaft in which the sprinkler rotates, the arc through which the sprinkler operates can be controlled.

The arc adjustment structure heretofore used on prior art rotary sprinklers has primarily involved the use of ring clips frictionally engaged around the shaft with tabs protruding therefrom to serve as the stop for the reversing mechanism. Though the frictional clips offer adequate resistance to visible slippage of the clips through several impulses, the accumulated slippage due to several impacts may be enough to require resetting of the clips to their original positions. To overcome this problem, some sprinklers have incorporated detented serrations of various types to more positively maintain the clip positions so that no creepage will occur. For many plastic sprinklers, these detents may be economically molded into the parts. On other heavy duty metal sprinklers, however, correspondingly heavy duty detents become costly in comparison with conventional friction clips. Moreover, because of wear or deformation of the ring clips, the clips may lose their ability to maintain the position relative to the shaft at which they are set. When this occurs, control of the arc through which the sprinkler operates is no longer possible and either new ring clips or an entire sprinkler system must be substituted. Further, in the systems using the ring clips, adjustment is accomplished by overcoming the friction between the clip and the shaft of the sprinkler. Thus, where the clip is produced to tightly engage the shaft in order to prevent slippage during operation, adjustment of the ring clips by the operator of the sprinkler is made more difficult. In some prior art sprinklers, the simple single member omega shaped clip has been replaced by several parts, including springs and other additional structure in order to positively engage the clip to the sprinkler shaft. Likewise, one prior art arc adjustment structure incorporates relatively wide sheet metal clips, oriented with their flat surfaces in a horizontal claim. This arrangement is unacceptable because of the excess space taken up by the clips which could be allotted to maximum arc adjustment. Therefore, a need has arisen for a system which provides for easy and positive adjustment of the stops for controlling the arc through which a rotary sprinkler operates.

SUMMARY OF THE INVENTION

The present invention provides an arc adjustment for overcoming many of the limitations heretofore found in prior art systems while providing adjustment structure for easily and positively maintaining the arc through which a rotary sprinkler operates. The present system includes an arc adjustment structure for a rotary sprinkler having a rotatable nozzle supported from a shaft with the reversing mechanism attached to the nozzle and extending from the nozzle in the direction of the shaft. A notched ring or gear is fixedly attached to the shaft below the nozzle. A first wire locking collar has one end compressively encircling the shaft above the notched ring and the opposite end formed in a loop extending radially from the shaft and terminating in a lateral end section for engagement with the notches of the ring. A second wire locking collar has one end compressively encircling the shaft below the ring with the opposite end formed in a loop extending radially from the shaft and terminating in a lateral end section for engagement with the notches of the ring.

The locking collars are positioned such that the loops intercept the actuating arm of the reversing mechanism as the nozzle of the rotary sprinkler rotates on the shaft. The locking collars are positioned to any selected point about the circumference of the notched ring by grasping the loop formed in the collar, disengaging the lateral end section from the notches of the ring and rotating the collar to the selected point on the ring. The wire forming the collar acts as its own spring to reengage the lateral end section with the notches in the ring.

In a more specific embodiment of the invention, a keyway is formed longitudinally along the outer surface of the shaft and the ring is formed with a radially, inwardly extending key for engaging the keyway in the shaft. In this way, the ring is restricted from movement relative to the shaft and maintains the arc adjustment provided by the locking collars.

In another embodiment of the invention, a first annular groove is formed in the shaft immediately above the ring and a second annular groove is formed in the shaft immediately below the ring. The portion of the locking collar encircling the shaft moves in these annular grooves and are thereby restrained from moving longitudinally along the shaft relative to the ring.

In one embodiment of the invention, the ring is formed with 36 notches such that each locking collar may be adjusted in 10° increments by moving the end section of the collar one notch in the ring.

DESCRIPTION OF THE DRAWINGS

For a more complete understanding of the present invention, and for further details and advantages thereof, reference is now made to the following description taken in conjunction with the accompanying drawings in which.

DESCRIPTION OF THE PREFERRED EMBODIMENTS

Figures 1, 2:
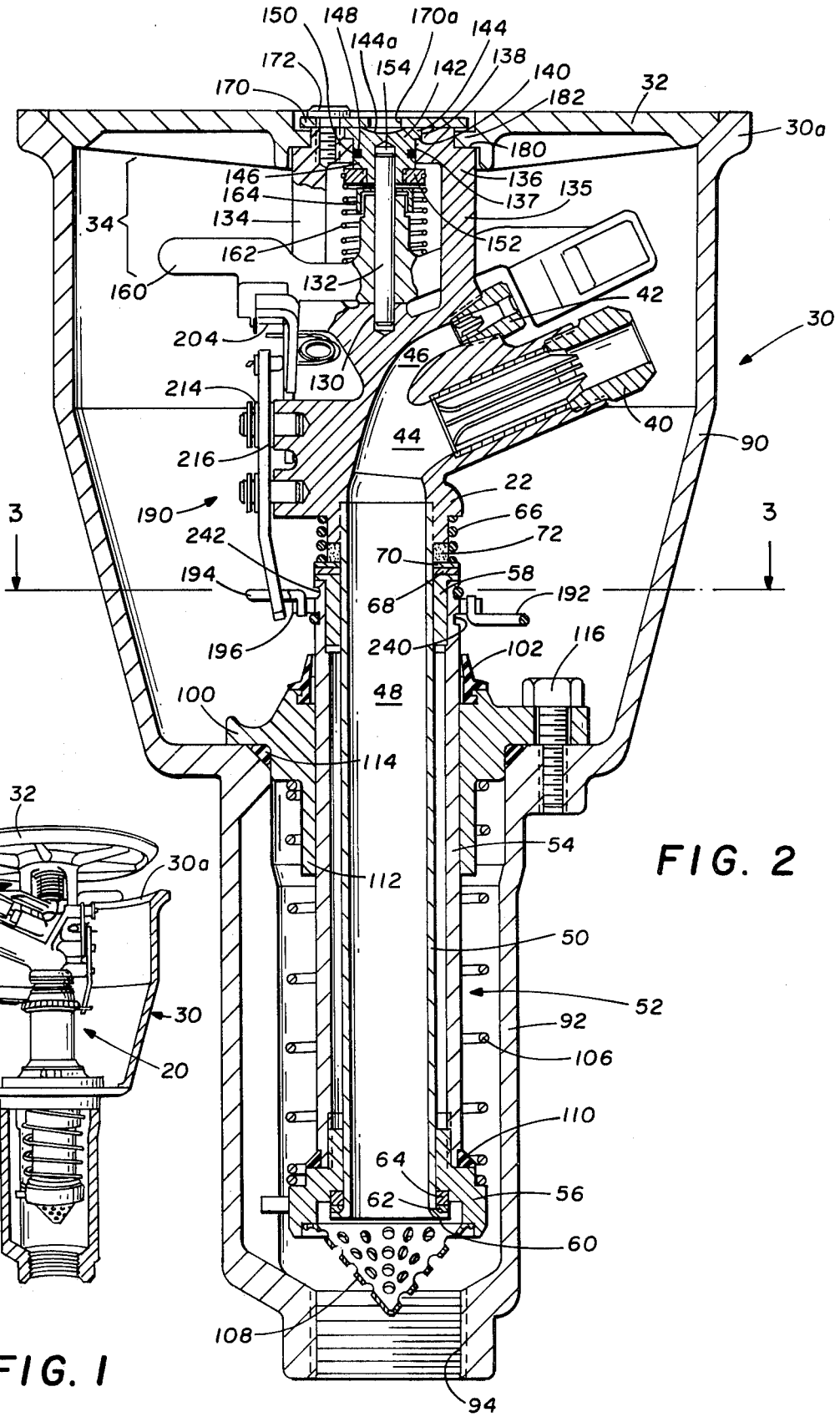
FIG. 1 illustrates a partially broken away perspective view of a rotary pop-up sprinkler embodying the present invention.
FIG. 2 is a vertical section of the sprinkler illustrated in FIG. 1.

FIG. 1 illustrates a partially broken away perspective view of a rotary impulse sprinkler 20 embodying the present invention. Sprinkler 20 includes a nozzle housing 22 supported on an extension tube section 26. The sprinkler 20 illustrated in FIG. 1 is of the "pop-up" type wherein the sprinkler is normally positioned within a bucket like housing 30 when not in operation but automatically is elevated out of housing 30 by the passage of water through extension tube 26 and nozzle housing 22 when the sprinkler 20 is operating. A cover 32 is supported from nozzle housing 22 by a cage structure 34. Normally, housing 30 is positioned within the ground with its upper opening 30*a* level with the ground. Thus, when sprinkler 20 is in the off position, and retracted within housing 30, cover 32 mates with opening 30*a* of housing 30 to seal sprinkler 20 within the housing. This provides protection to the sprinkler and completes the ground surface by providing cover 32 level with the ground surface.

Referring to FIG. 2, nozzle housing 22 includes a range nozzle 40 and a drive nozzle 42 positioned thereabove. Both nozzles communicate by way of internal bores 44 and 46 with bore 48 of flow tube 50 which is threadedly engaged at its upper end within nozzle housing 22. The flow tube 50 is mounted within a guide tube assembly 52 including a guide tube 54 threadedly attached at its lower end to a lower bearing assembly 56 and fitted at its upper end with an upper bearing assembly 58. Flow tube 50 has an outwardly extending radial flange 60 on which a thrust washer 62 and a lower thrust bearing 64 rest. A preload compression spring 66 acts between nozzle housing 22 and upper bearing assembly 58 of guide tube assembly 52 to apply a compression load on thrust washer 62 and thrust bearing 64 between flange 60 of flow tube 50 and lower bearing 56 of guide tube assembly 52. Preload thrust washer 68 and preload spring washer 70 are positioned between nozzle housing 22 and upper bearing 58. An upper tube seal 72 is likewise positioned between nozzle housing 22 and preload spring washer 70.

Housing 30 includes an upper chamber 90 having an aperture in the lower end thereof communicating to lower chamber 92. Lower chamber 92 has a threaded coupling 94 at the bottom end thereof for accepting a conduit for furnishing water or other fluid to the sprinkler system. The lower end of upper chamber 90 has a landing for receiving guide collar 100 in which guide tube assembly 54 slides.

An annular guide tube wiper ring 102 having an inner diameter aperture closely approximating the outer diameter of guide tube 54 is fitted to guide collar 100 and closely receives guide tube 54 to clean the guide tube as it translates past wiper ring 102. A retraction compression spring 106 encircles guide tube 54 and is compressed between guide collar 100 and a flange landing on lower bearing 56. A strainer 108 is fitted in the lower opening of lower bearing 56 adjacent the opening to flow tube 50.

An annular guide seal 110 is positioned around an upper landing formed on lower bearing 56 and is shaped to mate with a complementary surface 112 at the lower end of guide collar 100. A housing guide seal 114 is fitted between guide collar 100 and housing 30 and is compressed to form a fluid tight seal therebetween when guide collar 100 is fastened to housing 30 by bolts 116.

Nozzle housing 22 has a bore 130 in the head area thereof which receives the lower end of arm pin 132. Cage structure 34 includes arms 134 and 135 extending upwardly from nozzle housing 22 and terminating at their upper end in a top plate 136. Top plate 136 includes a bore 137 in the head thereof and a larger concentric bore 138 extending partially therethrough to form shoulder 140 in top plate 136. A spring adjust bushing 142 fits within bore 137 through the top plate and has a slotted head 144 which seats on shoulder 140 and a lower shaft 146 for extending through bore 137.

Shaft 146 has an annular groove 148 therearound and receives an O-ring 150 which partially extends outside of the outer diameter of shaft 146. The lower end of shaft 146 is threaded to receive a spring support ring 152. Shaft 146 further has an internal bore 154 for receiving the upper end of arm pin 132. Impact arm 160 is journaled on arm pin 132 and receives the lower end of impact arm spring 162. The upper end of spring 162 is attached to spring adjust bushing 142 by way of spring support ring 152. An arm cap 164 is positioned between spring support ring 152 and impact arm 160 and is likewise journaled on arm pin 132. Therefore, impact arm 160 is free to rotate about arm pin 132 which in turn is supported at the lower end in bore 130 in nozzle housing 22 and at the upper end in bore 154 of spring adjust bushing 142. Head 144 of spring support bushing 142 is slightly thicker in dimension than the depth of bore 138 and therefore extends slightly above the upper surface of top plate 136 when positioned in bore 137 and supported on shoulder 140. In one embodiment of the invention, head 144 extends 20,000ths of an inch above the upper surface of top plate 136. A retainer plate 170 is attachable to top plate 136 of cage assembly 34 by retainer bolts 172 which are threadably engaged into top plate 136 and clamp retainer plate 170 against top plate 136. Because of the protrusion of head 144 of bushing 142 above the upper surface of top plate 136, the engagement of retainer plate 170 against top plate 136 locks bushing 142 by compressing the bushing between retainer plate 170 and shoulder 140 of top plate 136. In this way, bushing 142 is maintained in any selected position relative to top plate 136 of cage 34.

Top plate 136 is further provided with an outer annular landing 180 for receiving annular web 182 of cover 32. As can be seen in FIG. 2, web 182 is sized such that retainer plate 170 does not engage the upper surface thereof but overlaps the web to retain cover 32 on top plate 136 without fixedly securing it to the top plate. Cage 34 and top plate 136 are positioned relative to the other structure of sprinkler 20 such that when sprinkler 20 is in the off or retracted position cover 32 mates with the upper opening of housing 30 to cover the opening thereby protecting sprinkler 20.

In operation of the system illustrated in FIGS. 1 and 2, a water or other fluid source is connected to coupling 94 of housing 30. As water is introduced through coupling 94 into lower chamber housing 92, it is communicated through flow tube 50 and nozzles 40 and 42. The force of the water through the flow tube and out of the restricted nozzle area imparts a vertical force on sprinkler 20 sufficient to compress retract spring 106 thereby lifting the nozzles out of upper chamber housing 90.

Case structure 34 and cover 32 rise in conjunction with the vertical movement of sprinkler 20 such that the sprinkler operates out of housing 90 and above the ground surface in which the housing is normally positioned.

Figure 3:
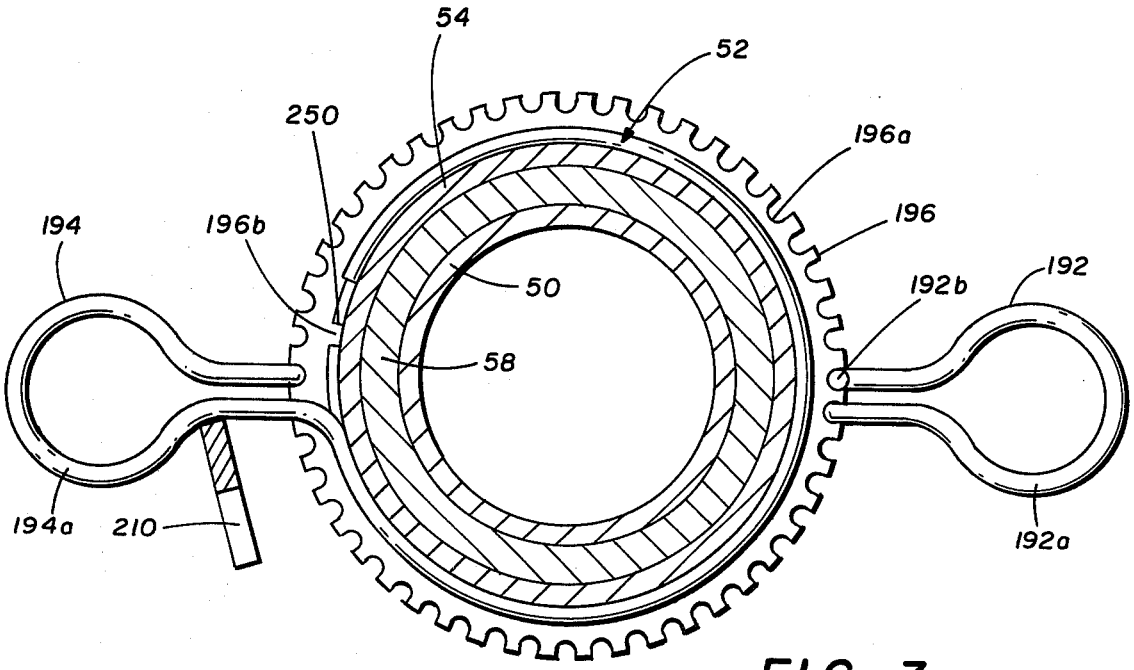
FIG. 3 is a section view taken along the line 3—3 of FIG. 2.
Figure 4:
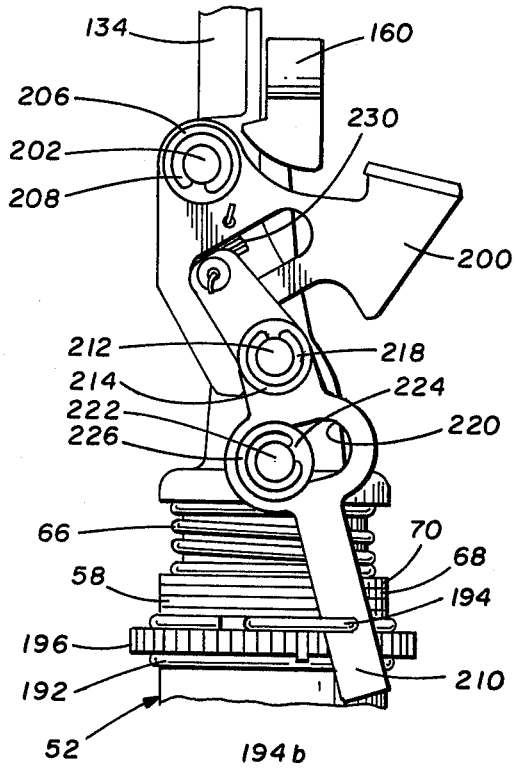
FIG. 4 is a side view of the arc adjustment and reversing mechanism of the present invention.

Referring to FIGS. 2, 3 and 4, a reversing mechanism 190 is attached to nozzle housing 22 and cooperates with locking collars 192 and 194 to control the arc through which the sprinkler moves. Reversing mechanism 190 includes a reverse arm 200 pivotally attached to nozzle housing 22 by pin 202. Reverse arm 200 is retained on pin 202 by an arm bearing 204, friction washer 206 and retaining ring 208. A trip lever 210 is likewise pivotally attached to nozzle housing 22 by mount pin 212. Lever 210 is attached to pin 212 having friction washers 214 and 216 positioned on opposite sides of the lever and by retaining clip 218. Trip lever 210 has an arcuate slot 220 formed therein which receives lever pin 222 therethrough. The end of lever pin 222 is fitted with a friction washer 224 and a retaining clip 226 similar to that provided for pins 202 and 212. While trip lever 210 is free to rotate about pin 212, pin 222 limits the rotation to that permitted by slot 220. The upper end of trip lever 210 is attached to reverse arm 200 by torsion spring 230. As is seen in FIGS. 3 and 4, locking collars 192 and 194 lie in the path of the lower end of trip lever 210.

In operation of the sprinkler as when nozzle housing 22 is rotating clockwise as seen in FIG. 3, trip lever 210 contacts locking collar 194 causing it to rotate counter clockwise as seen in FIG. 4. As trip lever rotates counter clockwise, torsional spring 230 forces reverse arm 200 counter clockwise about pin 202. In this arrangement, reverse arm 200 is positioned in the path of impact arm 160 as it oscillates about the shaft to reverse the direction of movement of nozzle housing 22. Thus, as nozzle housing 22 rotates counter clockwise as seen in FIG. 3, the lower end of trip lever 210 engages locking collar 192 to rotate it in a clockwise direction as seen in FIG. 4. By so doing, torsion spring 230 is pivoted to cause reverse arm 200 to rotate in a clockwise direction as seen in FIG. 4 thereby removing reverse arm 200 from the oscillating path of impact arm 160 thereby reversing the direction of rotation of nozzle housing 22. Therefore, by positioning locking collars 192 and 194 at desired points about the circumference of guide tube 54, the arc through which the rotary sprinkler operates may be controlled.

As can be seen in FIG. 2, annular grooves 240 and 242 are formed in guide tube 54 and provide a track in which locking collars 192 and 194 travel. These annular grooves are positioned immediately above and below notched ring 196 thereby maintaining the locking collars adjacent to the ring. It will be also noted that the portion of locking collars 192 and 194 seated in annular grooves 240 and 242 prevent ring 196 from moving longitudinally along guide tube 54.

Notched ring 196 has a plurality of notches **196*a* formed about the entire circumference thereof. Ring 196 has an inner diameter substantially conforming to the outer diameter of guide tube 54 and is positioned on guide tube 54 immediately between annular grooves 240 and 242. A keyway 250 is formed longitudinally along guide tube 54 and a corresponding key 196*b* is integrally formed on the inner circumference of ring 196 to mate with keyway 250. In this way, ring 196 is prevented from rotating relative to guide tube 54**.

Referring to FIGS. 2 and 3, locking collars 192 and 194 are formed from a heavy wire material and include a portion compressively encircling guide tube 54 and seated in annular grooves 240 and 242. One end of each of the locking collars is formed in loops **192*a* and 194*a*, respectively, extending radially from guide tube 54 and terminating in a lateral end section 192*b* and 194*b* for mating with the notches 196*a* formed in detent ring 196. Thus, the lateral end sections 192*b* and 194*b* are received in notches 196*a* of ring 196 and are maintained in any selected position about the circumference of ring 196 by the spring force applied by the portion of locking collars 192 and 194 encircling guide tube 54. The adjustment of locking collars 192 and 194 about the circumference of ring 196 is accomplished by engaging loops 192*a* or 194*a*, withdrawing the lateral end 192*b* or 194*b* from notches 196*a* of ring 196** and rotating the locking collars to any desired position about the ring.

It will be appreciated that the present locking collar assembly provides a system for easily adjusting the stops for activating the reverse mechanism for rotary sprinklers while providing a positive engagement between the stops and the structure on which the sprinkler rotates. Moreover, the system provides stops which are easily manufactured from common material, such as wire, in the case of the locking collars and metal or plastic, in the case of the annular ring. As is evident from the structure illustrated and described, the engagement of locking collars 192 and 194 with ring 196 is a very positive engagement which is substantially uneffected by wear resulting from the continuous adjustment of the arc control. This is a result of the design of the ring having relatively deep notches therein as well as the spring effect created by the locking collars which engages the lateral portion of the collar within the notches. However, the design still provides for ease of adjustment of the collars relative to the notched ring.

As is illustrated in FIG. 3, ring 196 is formed with 36 notches and therefore has 36 equal spaced positions therearound. Thus, the system provides for adjustments in 10 degree increments by moving the lateral end of the collars over one notch in ring 196. Moreover, the notches are sufficiently sized such that the arc desired may be set by merely counting the number of notches between the locking collars, and increased angles of arc rotation may be set by merely counting the number of notches over which the locking collar is moved. This is contrasted with the prior art systems where the engagement between the stops and the sprinkler structure is merely by a smooth frictional engagement or by minute indentions which do not provide such a ready reference to adjusting the arc through which the sprinkler will operate.

While FIG. 3 illustrates ring 196 as having 36 notches, it will be apparent to one skilled in the art that more or fewer divisions can be provided to alter the degree of adjustment permitted. Thus, the present invention discloses a system for easily setting the desired arc through which the rotary sprinkler operates which is both positive in its engagement with the structure on which the sprinkler rotates as well as being simply and inexpensively produced.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention.

What is claimed is:

1. Arc adjustment apparatus for a rotary sprinkler having a rotatable nozzle supported from a shaft and a reversing mechanism attached to the nozzle comprising:

a notched circumferential surface on the shaft, and first and second locking collars each having a band portion encircling and compressively engaging the shaft adjacent said circumferential surface to restrict said collars from moving longitudinally from said circumferential surface, and an extension extending from the band portion of each locking collar for selective engagement with the notches of said circumferential surface.

2. The arc adjustment apparatus of claim 1 wherein said notched circumferential surface is a notched ring fixedly attached to the shaft.

3. The arc adjustment apparatus of claim 2 further comprising:

a key way formed longitudinally along the outer surface of the shaft and wherein said ring is formed with a radially inwardly extending key for engaging the key way in said shaft.

4. The arc adjustment apparatus of claim 2 further comprising:

a first annular groove formed in the shaft immediately above said ring and a second annular groove formed in the shaft immediately below said ring and wherein the band end of one of said locking collars moves in said first annular groove and the band end of said second locking collar moves in said second annular groove.

5. The arc adjustment apparatus of claim 1 wherein said locking collars are made of wire.

6. Arc adjustment apparatus for a rotary sprinkler having a rotatable nozzle supported from a shaft and a reversing mechanism attached to the nozzle and extending from the nozzle in the direction of said shaft, comprising:

an annular gear fixedly attached to the shaft below the nozzle, a first wire locking collar having one end compressively encircling the shaft above said annular gear and the opposite end formed in a loop extending radially from the shaft and terminating in a lateral end section for engagement with the notches of said gear;

a second wire locking collar having one end compressively encircling the shaft below said annular gear with the opposite end formed in a loop extending radially from the shaft and terminating in a lateral end section for engagement with the notches of said gear, said locking collars being positioned such that said loops intercept the actuating arm of the reversing mechanism as the nozzle of the rotary sprinkler rotates on the shaft.

7. The arc adjustment apparatus of claim 4 further comprising:

means for circumferentially keying said ring to the shaft.

8. The arc adjustment apparatus of claim 6 further comprising:

a first annular groove formed in the shaft above said ring and a second annular groove formed in the shaft below said ring and wherein the band end of one of said locking collars moves in said first annular groove and the band end of said second locking collar moves in said second annular groove.

9. The arc adjustment apparatus of claim 6 wherein said annular ring is formed with 36 notches therein such that each locking collar may be adjusted in 10° increments by moving the collar one notch of said gear.

10. The arc adjustment apparatus of claim 6 further comprising:

a first annular groove formed in the shaft above said ring and a second annular groove formed in the shaft below said gear and wherein the band end of one of said locking collars moves in said first annular groove and the band end of said second locking collar moves in said second annular groove.

11. Arc adjustment apparatus for a rotary sprinkler having a rotatable nozzle supported from a shaft and a reversing mechanism attached to the nozzle comprising:

a notched ring fixedly attached to the shaft, first and second locking collars each having a band end encircling and engaging the shaft adjacent said ring, a loop formed by the opposite end extending radially from said shaft terminating in a lateral end portion for engagement with the notches of said ring.

12. The arc adjustment apparatus of claim 11 further comprising:

a first annular groove formed in the shaft immediately above said ring and a second annular groove formed in the shaft immediately below said ring and wherein the band end of one of said locking collars moves in said first annular groove and the band end of said second locking collar moves in said second annular groove.

13. The arc adjustment apparatus of claim 11 wherein said locking collars are made of wire.

14. Arc adjustment apparatus for a rotary sprinkler having a rotatable nozzle supported from a shaft and a reversing mechanism attached to the nozzle and extending from the nozzle in the direction of said shaft, comprising:

an annular gear fixedly attached to the shaft, a first locking collar having a band portion compressively encircling the shaft adjacent said annular gear, a first extension from said band portion extending substantially radially from the band portion, and a second extension from said band portion for engagement with the notches of said gear, and a second locking collar having a band portion compressively encircling the shaft adjacent said annular gear, a first extension from said band portion extending substantially radially from the band portion, and a second extension from said band portion for engagement with the notches of said gear, said locking collars being positioned such that said first extensions intercept the actuating arms of the reversing mechanism as the nozzle of the rotary sprinkler rotates on the shaft.

* * * * *